US006641002B2

(12) United States Patent
Gerenraich et al.

(10) Patent No.: US 6,641,002 B2
(45) Date of Patent: Nov. 4, 2003

(54) BATTERY BOTTLE

(75) Inventors: Kenneth B. Gerenraich, Seal Beach, CA (US); John J. Cogger, Irvine, CA (US)

(73) Assignee: Gerenraich Family Trust, Seal Beach, CA (US)

( * ) Notice: Subject to any disclaimer, the term of this patent is extended or adjusted under 35 U.S.C. 154(b) by 0 days.

(21) Appl. No.: 10/269,512

(22) Filed: Oct. 11, 2002

(65) Prior Publication Data

US 2003/0075562 A1 Apr. 24, 2003

Related U.S. Application Data

(60) Provisional application No. 60/329,839, filed on Oct. 15, 2001.

(51) Int. Cl.[7] ..... B65D 88/54

(52) U.S. Cl. ..... 222/333; 207/386.5; 4/623

(58) Field of Search ..... 222/386.5, 504, 222/333, 207, 209, 63, 52; 4/623

(56) References Cited

U.S. PATENT DOCUMENTS

| | | | | |
|---|---|---|---|---|
| 1,718,369 A | | 6/1929 | Lillford | |
| 1,811,574 A | | 6/1931 | Barrett | |
| 2,366,770 A | | 1/1945 | Cordwell | |
| 2,685,316 A | | 8/1954 | Krasno | |
| 2,780,378 A | | 2/1957 | Romano | |
| 3,273,752 A | * | 9/1966 | Horeczky | 222/52 |
| RE32,379 E | | 3/1987 | Touzani | |
| 4,722,372 A | * | 2/1988 | Hoffman et al. | 222/52 |
| 4,946,070 A | * | 8/1990 | Albert et al. | 222/52 |
| 5,310,068 A | | 5/1994 | Saghri | |
| 5,333,761 A | | 8/1994 | Davis et al. | |
| 5,377,363 A | | 1/1995 | Shieh | |
| 5,447,110 A | | 9/1995 | Brown | |
| 5,492,247 A | * | 2/1996 | Shu et al. | 222/63 |
| 5,667,101 A | | 9/1997 | Barrash et al. | |
| 5,988,440 A | | 11/1999 | Saunders et al. | |
| 6,016,853 A | * | 1/2000 | Wang | 222/207 |
| 6,029,854 A | | 2/2000 | Wissen | |
| 6,161,726 A | * | 12/2000 | Parsons et al. | 222/63 |
| 6,234,366 B1 | | 5/2001 | Fuchs | |

* cited by examiner

*Primary Examiner*—Philippe Derakshani
(74) *Attorney, Agent, or Firm*—Walter A. Hackler

(57) ABSTRACT

A bottle assembly for a battery powered dispenser includes a container for storing a dispensable fluid, a pump fixed to the container for releasing metered amounts of fluid from the container in response to a battery operated actuator disposed in the dispenser. A battery carrier, fixed to the container, provides power to the actuator. A base is provided for supporting the container and the battery carrier and enabling collapse of the container without interference with the battery carrier. A size and number of batteries are calibrated to provide an adequate power supply for the dispenser to dispense all of the fluids stored in the container.

15 Claims, 1 Drawing Sheet

BATTERY BOTTLE

The present application is a continuation of U.S. Ser. No. 60/329,839 filed Oct. 15, 2001.

The present invention is generally directed to a collapsible container for storing a fluid, such as, for example, liquid soap, to be metered to a user through a dispensing device.

Bottles and containers made from flexible or semi-rigid plastic materials are well known in the art. Such containers have been fabricated from such materials as polyvinyl chloride, polyethylene, polypropylene and polycarbonate.

Many types of liquid soaps, detergents and deodorants for personal hygiene are supplied in such containers which are designed to be inserted into a dispenser provided with hand actuated pumps.

Often the dispensers are designed such that as a liquid is pumped from the container, air backflows into the container to replace the displaced fluid. This exposure to air can lead to degradation and shortened lifetime of the fluid due to, for example, oxidation and contamination.

This in turn, may cause thickening of the fluid, by oxidation or evaporation which may result in blockages of the pumping mechanism in the dispenser.

Collapsible containers have been utilized wherein a fluid is dispensed from the container by a pump and an airtight seal of the container prevents air from being drawn into the container. The container slowly collapses as the fluid volume therein decreases. This design reduces exposure of the fluid to air which in turn decreases oxidation and contamination of the fluids contained therein, thus increasing the useful shelf life of the liquid or fluid.

Another problem associated with battery-powered dispensers is the separate requirement of battery replacement.

The present invention provides for a bottle assembly for a battery-powered dispenser in which a battery and a collapsible bottle are coupled as a unit. Thus, no separate handling of batteries is necessary and the battery may be sized so that its life is depleted when the fluid is completely dispensed.

SUMMARY OF THE INVENTION

A bottle assembly in accordance with the present invention for a battery-powered dispenser generally includes a container for storing a dispensable fluid and a pump, fixed to the container, for releasing metered amounts of the fluid from the container in response to a battery operated actuator disposed in the dispenser.

A battery carrier is fixed to the container for providing power to the actuator. The battery carrier includes means for enabling electrical connection between the batteries disposed in the battery carrier and the actuator.

Thus, the batteries and collapsible container are coupled as a unit and, as hereinabove noted, no separate handling of batteries is necessary. The battery life capacity is coupled to the collapsible container volume and the depleted bottle assembly is disposed with no additional handling for the battery assembly.

More particularly, the container is collapsible, preferably with accordion-like convolutions in walls of the container for enabling collapse thereof. The batteries are preferably sealed within the battery carrier and a size and number of the batteries are calibrated to provide an adequate power supply for the dispenser to dispense all of the fluid stored in the container.

A base is provided for supporting the container and the battery carrier while enabling collapse of the container without interference with the battery carrier. More specifically, the container may include a curvilinear wall interconnected with a linear wall and a battery carrier may be supported adjacent the container linear wall. This provides for a small footprint.

BRIEF DESCRIPTION OF THE DRAWINGS

The advantages and features of the present invention will be better understood by the following description when considered in conjunction with the accompanying drawings, in which.

DETAILED DESCRIPTION

Figure 1:
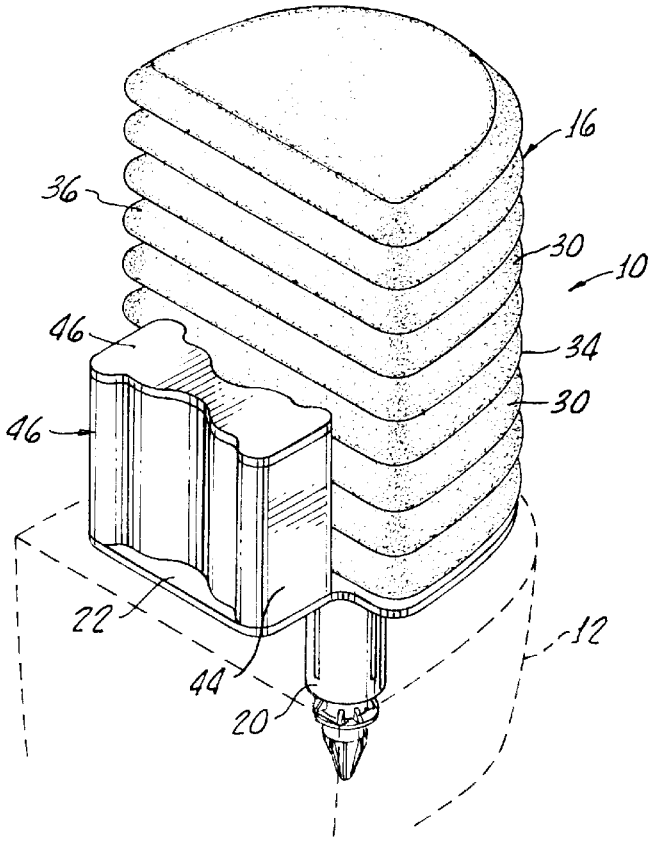
FIG. 1 is a perspective view of a bottle assembly in accordance with the present invention as it may be installed on a battery powered dispenser along with a pump fixed to the container and a battery carrier fixed to the container by a base.
Figure 2:
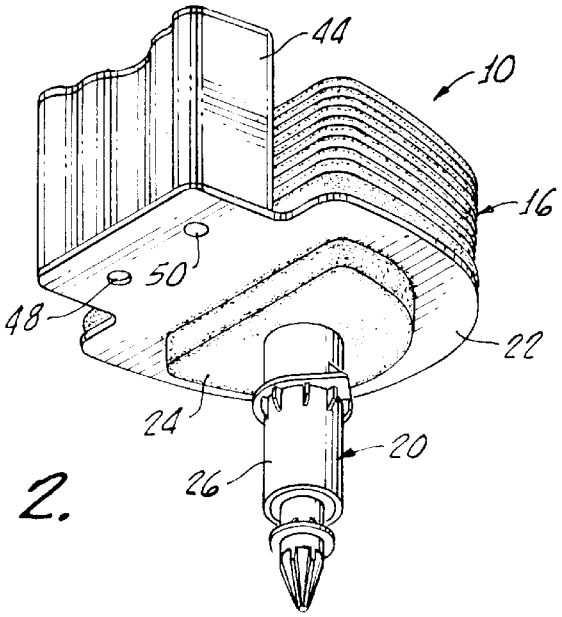
FIG. 2 is another perspective view of the bottle assembly with a collapsed container, showing a bottom portion thereof including the base and the pump fixed to the container and extending downwardly from the base for releasing metered amounts of the fluid from the container.

With reference to FIGS. 1 and 2, there is shown a bottle assembly 10 for a battery powered dispenser 12 which may include a collapsible container 16, shown full of a dispensable fluid in FIG. 1 and empty of the dispensable fluid in FIG. 2.

The battery-powered dispenser 12 shown in dashed line in FIG. 1 is fully described in U.S. patent application Ser. No. 10/269,565 entitled "TOUCH FREE DISPENSER" filed on even date herewith. This application is to be incorporated into the present application, including all drawings and specifications for the purpose of describing a battery powered dispenser for use with the bottle assembly 10 described herein.

A pump 20 is fixed to the container 16 through a base 22 and a fitment 24. Preferably an exterior 26 of the pump 20 is formed from a material common to the container 16 and base 22 and may be ultrasonically attached thereto to provide a sealed communication between the pump 20 and the container 16. The pump 20 may be of any conventional design.

The container 16 is preferably formed from a pleated polyethylene blow-molded material that collapses under the differential pressure created by dispensing a fluid, or liquid product, therefrom.

As shown in the figures the container 16 includes accordion-like convolutions 30 enabling the collapse of the container as shown in FIG. 2.

The container 16 includes a curvilinear wall 34 interconnected with a linear wall 36 and a battery carrier 40 is disposed on the base 22 adjacent to the linear wall 36. The independent fixing of the carrier 40 and collapsible container 16 on the base 22 enables uninterfered collapse of the container on the base as illustrated in FIG. 2. Batteries 44, shown in dashed line, are sealed within the carrier 40 between the base 22 and a cap 46 and provide a battery pack for providing power to an actuator (not shown) which is part of the dispenser 12 for actuating the pump 20. Contacts 48, 50 extending through the base 22 provide a means for enabling electrical connection between the battery 44 and the actuator in a conventional manner.

Thus, the batteries 44 within the carrier 40 are permanently fixed within the bottle assembly 10 in a manner not impeding the collapsing function of the bottle as illustrated. The size and number of the batteries 44 may be calibrated to provide an adequate power supply to the actuator for the dispensing of the total fluid volume contained in the collapsible container 16.

The carrier 40 may be an injection molded polyethylene material into which the batteries 44 are inserted. Soft walls of the container 40 provide a clamping and locking force against the sides of the batteries 44, thus eliminating movement during handling and shipping. The cap, or lid, 46 is ultrasonically welded or otherwise appropriately and permanently fixed to the carrier 40.

It should be appreciated that the container 16 may be provided in a different fluid capacities and a corresponding change in battery capacity via size or quantity coupled tooth body in order that the battery and container 16 are depleted in a simultaneous manner through operation of the dispenser 12. The capacity of the batteries 44 is, of course, depending on the power requirements to dispense all of the fluid in the container 16 and may be especially calculated or otherwise by conventional methods. Preferably, the provided battery 44 capacity is equal to an amount of power necessary to only dispense the fluid stored in the container and no more. This provides for efficient and economic advantages.

Although there has been hereinabove described a specific battery bottle in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclose herein. Accordingly, any and all modifications, variations or equivalent arrangements which may occur to those skilled in the art, should be considered to be within the scope of the present invention as defined in the appended claims.

What is claimed is:

1. A bottle assembly for a battery powered dispenser, the assembly comprising:

a collapsible container for storing a dispensable fluid;

a pump, fixed to said container, for releasing metered amounts of the fluid from said container in response to a battery operated actuator disposed in the dispenser;

a battery carrier, fixed to said container, for providing power to the actuator, said battery carrier having means for enabling electrical connection between batteries disposed in said battery carrier and the actuator; and a base for supporting said collapsible container and said battery carrier in a side-by-side relationship for enabling collapse of said collapsible container without interference with said battery carrier.

2. The assembly according to claim 1 further comprising batteries sealed within said battery carrier.

3. The assembly according to claim 2 wherein the container includes accordion like convolutions in walls of the container for enabling collapse thereof.

4. The assembly according to claims 1 wherein a size and number of the batteries are calibrated to provide an adequate power supply for the dispenser to dispense all of the fluid stored in said container.

5. The assembly according to claim 1 wherein said container includes a curvilinear wall interconnected with a linear wall.

6. The assembly according to claim 5 wherein said battery carrier is supported adjacent the container linear wall.

7. The assembly according to claim 6 wherein said pump depends from a side of the base opposite a side supporting said container.

8. A bottle assembly for a battery powered fluid dispenser, the assembly comprising:

a dispensable fluid;

a disposable collapsible container for storing the dispensable fluid;

a pump, fixed to said container and disposable therewith, for releasing metered amounts of the fluid from the container in response to a battery operated actuator disposed in the dispenser;

a battery pack for providing power to the actuator;

a battery carrier fixed to said container and disposable therewith, and including means for enabling electrical connection between the battery pack and the actuator; and a base for supporting said collapsible container and said battery carrier in a side-by-side relationship for enabling collapse of said collapsible container without interference with said battery carrier.

9. The assembly according to claim 8 wherein the container is sealed with the fluid stored therein.

10. The assembly according to claim 9 wherein said battery pack is sealed within said battery carrier and disposable therewith.

11. The assembly according to claim 8 wherein a capacity of the battery pack is calibrated to provide an adequate power supply for the dispenser to dispense all of the fluid.

12. The assembly according to claim 8 wherein the container includes accordion like convolutions in walls of the container for enabling collapse thereof.

13. The assembly according to claim 8 wherein said container includes a curvilinear wall interconnected with a linear wall.

14. The assembly according to claim 13 wherein said battery carrier is supported adjacent the container linear wall.

15. The assembly according to claim 14 wherein said pump depends from a side of the base opposite a side supporting said container.

* * * * *